US008723851B2

(12) United States Patent
Choe

(10) Patent No.: US 8,723,851 B2
(45) Date of Patent: May 13, 2014

(54) DATA DRIVE CIRCUIT OF FLAT PANEL DISPLAY AND DRIVING METHOD THEREOF

(75) Inventor: Won-Jun Choe, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 61 days.

(21) Appl. No.: 12/983,811

(22) Filed: Jan. 3, 2011

(65) Prior Publication Data

US 2012/0013598 A1 Jan. 19, 2012

(30) Foreign Application Priority Data

Jul. 19, 2010 (KR) ..... 10-2010-0069507

(51) Int. Cl.
*G09G 5/00* (2006.01)

(52) U.S. Cl.
USPC ..... 345/209; 345/54; 345/79; 345/96

(58) Field of Classification Search
USPC ..... 345/54, 79, 96, 48, 53, 90, 94, 204–214
See application file for complete search history.

(56) References Cited

U.S. PATENT DOCUMENTS

| | | | | |
|---|---|---|---|---|
| 6,529,180 | B1 * | 3/2003 | Ito et al. | 345/89 |
| 7,005,916 | B2 * | 2/2006 | Nakahira et al. | 330/9 |
| 2002/0008687 | A1 * | 1/2002 | Tazuke | 345/96 |
| 2002/0041274 | A1 * | 4/2002 | Watanabe | 345/204 |
| 2003/0146923 | A1 * | 8/2003 | Nakahira et al. | 345/690 |
| 2004/0108988 | A1 * | 6/2004 | Choi | 345/96 |
| 2006/0017680 | A1 * | 1/2006 | Chen et al. | 345/96 |
| 2006/0098032 | A1 * | 5/2006 | Nakahira et al. | 345/690 |
| 2007/0024562 | A1 * | 2/2007 | Choi | 345/96 |
| 2007/0242024 | A1 * | 10/2007 | Sung | 345/100 |
| 2009/0102777 | A1 * | 4/2009 | Izumikawa et al. | 345/96 |
| 2009/0109198 | A1 * | 4/2009 | Kim et al. | 345/204 |
| 2009/0278868 | A1 * | 11/2009 | Nakahira et al. | 345/690 |
| 2011/0025663 | A1 * | 2/2011 | Bae | 345/209 |

FOREIGN PATENT DOCUMENTS

| | | |
|---|---|---|
| JP | 2001-125543 A | 5/2001 |
| JP | 2008-067050 | 3/2008 |
| KR | 10-2004-0049172 | 6/2004 |
| KR | 10-2005-0078269 A | 8/2005 |

(Continued)

OTHER PUBLICATIONS

Korean Office action dated Oct. 31, 2011 issued in Korean Priority Application No. 10-2010-0069507, 4 pages.

(Continued)

*Primary Examiner* — Dmitriy Bolotin
(74) *Attorney, Agent, or Firm* — Christie, Parker & Hale, LLP

(57) ABSTRACT

The data driver of a flat panel display includes: an output driver configured to output a plurality of amplified data signals for a plurality of channels corresponding to a plurality of data lines, the plurality of channels including: a plurality of amplifiers configured to amplify a plurality of input data signals and to supply the amplified data signals to the data lines; and a plurality of chopping controllers, each of the chopping controllers being coupled connected to a plurality of input terminals of a corresponding amplifier of the amplifiers and configured to receive a first control signal or a second control signal to periodically change signals applied to positive and negative input terminals from among the input terminals of the amplifiers.

13 Claims, 6 Drawing Sheets

(56) References Cited

FOREIGN PATENT DOCUMENTS

| | | | |
|---|---|---|---|
| KR | 10-0800494 | | 1/2008 |
| KR | 10-2008-0034763 | A | 4/2008 |
| KR | 10-0833200 | | 5/2008 |
| KR | 1020090079113 | A | 7/2009 |

OTHER PUBLICATIONS

KIPO Office Action dated Jun. 26, 2012 for KR 10-2010-0069507 (1 page).

* cited by examiner

Frame N

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

+

Frame N+1

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

→

| | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |

Frame N

| | | | | | | | |
|---|---|---|---|---|---|---|---|
| + | + | + | + | + | + | + | + |
| − | − | − | − | − | − | − | − |
| + | + | + | + | + | + | + | + |
| − | − | − | − | − | − | − | − |
| + | + | + | + | + | + | + | + |

+

Frame N+1

| | | | | | | | |
|---|---|---|---|---|---|---|---|
| − | − | − | − | − | − | − | − |
| + | + | + | + | + | + | + | + |
| − | − | − | − | − | − | − | − |
| + | + | + | + | + | + | + | + |
| − | − | − | − | − | − | − | − |

→

| | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |

Frame N

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

+

Frame N+1

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

→

| | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |

DATA DRIVE CIRCUIT OF FLAT PANEL DISPLAY AND DRIVING METHOD THEREOF

CROSS-REFERENCE TO RELATED APPLICATION

This application claims priority to and the benefit of Korean Patent Application No. 10-2010-0069507, filed on Jul. 19, 2010, in the Korean Intellectual Property Office, the entire content of which is incorporated herein by reference.

BACKGROUND

1. Field

Aspects of embodiments of the present invention relate to a flat panel display and a data driver of a flat panel display and a driving method thereof.

2. Description of the Related Art

In recent years, various flat panel displays that can overcome disadvantages of cathode ray tubes, e.g., the heavy weights and large volumes of the cathode ray tubes, have been developed. Such flat panel displays include liquid crystal displays (LCDs), field emission displays (FEDs), plasma display panels (PDPs), and organic light emitting displays (OLEDs).

Flat panel displays can be classified into active matrix type displays and passive matrix type displays. An active matrix type display includes a plurality of scan lines and a plurality of data lines, and a plurality of pixels connected to the lines and arranged in a matrix. Each pixel includes a thin film transistor as a switching device controlled by scan signals applied to a corresponding scan line.

That is, an active matrix type flat panel display includes pixels arranged in a matrix, a data driver (or data drive circuit) for driving data lines connected to the pixels, and a scan driver (or data drive circuit) for driving scan lines connected to the pixels.

Here, the scan driver sequentially supplies scan signals during horizontal periods to perform an operation of selecting pixels to which data signals are supplied, and the data driver supplies data signals corresponding to input data to the selected pixels to which the scan signals are applied to display an image using the pixels.

The data driver includes a plurality of amplifiers at an output terminal to output data signals to the data lines. However, there exist random DC offsets in the amplifiers for channels, so there exist variations between data signals that are actually output by the amplifiers even if data signals corresponding to the same value are supplied to the amplifiers.

The output variations between the channels that occur in the data driver including the plurality of amplifiers appear as brightness differences between vertical lines, and cause a deterioration in image quality in which stripes appear in the screen (or image).

In particular, of the active matrix type flat panel displays, organic light emitting displays undergo screen deteriorations due to the output variations between channels (or columns) more severely than liquid crystal displays employing reversal drive schemes.

SUMMARY

Accordingly, embodiments of the present invention provide a data driver that improves the screen quality of a flat panel display by removing stripes caused by output variations of amplifiers provided for channels, and a driving method thereof.

According to one embodiment of the present invention, a data driver of a flat panel display includes: an output driver configured to output a plurality of amplified data signals for a plurality of channels corresponding to a plurality of data lines, the plurality of channels including: a plurality of amplifiers configured to amplify a plurality of input data signals and to supply the amplified data signals to the data lines; and a plurality of chopping controllers, each of the chopping controllers being coupled to a plurality of input terminals of a corresponding amplifier of the amplifiers and configured to receive a first or second control signal to periodically change signals applied to positive and negative input terminals from among the input terminals of the amplifiers.

The first control signal may be applied to the chopping controllers provided in odd numbered channels of the channels and the second control signal may be applied to the chopping controllers provided in even numbered channels of the channels.

The chopping controller may include: a first switch coupled between the positive input terminal of an amplifier and an input line configured to supply a first data signal of the input data signals; a second switch coupled between the positive input terminal of the corresponding amplifier and a feedback line configured to feed back and apply a second data signal of the amplified data signals; a third switch coupled between the negative input terminal of the corresponding amplifier and the feedback line; and a fourth switch coupled between the negative input terminal and the input line.

The second data signal may be a signal obtained by amplifying the first data signal through the amplifier.

The first, second, third, and fourth switches may be configured to be turned off by the first control signal or the second control signal.

The first, second, third, and fourth switches may be thin film transistors.

The first and third switches may be thin film transistors of a first type and the second and fourth switches may be thin film transistors of a second type.

According to another embodiment of the present invention, a method of driving a data driver of a flat panel display, the method includes: applying a first data signal to first input terminals of amplifiers of channels corresponding to a plurality of data lines and applying a second data signal to second input terminals of the amplifiers; switching, periodically, the first data signal and the second data signal applied to first and second input terminals of amplifiers by applying first and second control signals; and outputting the second data signal to the plurality of data lines.

The second data signal may be a signal obtained by amplifying the first data signal through the amplifiers.

The first control signal may be applied to the amplifiers provided in odd numbered channels and the second control signal may be applied to the amplifiers provided in even numbered channels.

The first and second control signals may be applied at a first level during an n-th frame, and may be applied at a second level during an (n+1)-th frame, the second level having a polarity opposite to a polarity of the first level.

The first control signal may be applied at a first level having a first polarity during an n-th frame and may be applied at a second level having a second polarity opposite to the first polarity during an (n+1)-th frame, and the second control signal may be applied at the second level during the n-th frame and may be applied at the first level during the (n+1)-th frame.

The first and second control signals may be applied at a first level having a first polarity during a plurality of odd numbered time periods of an n-th frame and may be applied at a second level having a second polarity opposite to the first polarity during a plurality of horizontal time periods of the n-th frame, and the first and second control signals may be applied in the opposite way in the (n+1)-th frame.

The first signal may be applied at a first level having a first polarity during odd numbered horizontal time periods of an n-th frame and the second signal may be applied at a second level having a polarity opposite to the first polarity during an n-th frame, and the first and second control signals may be applied in the opposite way in an (n+1)-th frame.

According to aspects of embodiments of the present invention, deterioration of the screen quality due to vertical stripes can be reduced or prevented by reducing output variations for channels of a data driver.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
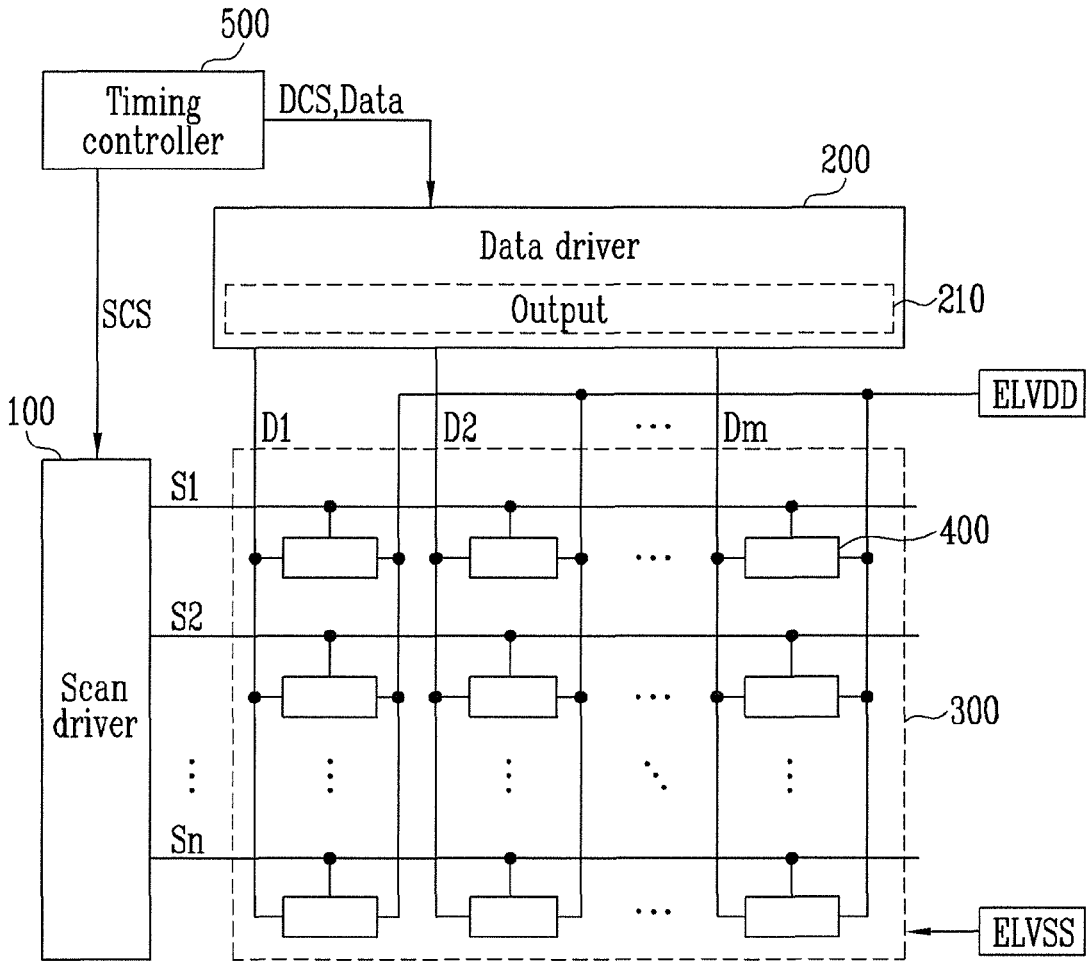
FIG. 1 is a schematic block diagram illustrating the configuration of a flat panel display according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to a complete understanding of the invention are omitted for clarity. Also, like reference numerals refer to like elements throughout.

Hereinafter, exemplary embodiments of the present invention will be described in more detail with reference to the accompanying drawings.

FIG. 1 is a schematic block diagram illustrating the configuration of a flat panel display according to an embodiment of the present invention.

Although an active matrix type organic light emitting display is illustrated as an example in the embodiment shown in FIG. 1, embodiments of the present invention are not limited thereto.

Referring to FIG. 1, a flat panel display according to one embodiment of the present invention includes a display unit 300 having a plurality of pixels 400 coupled to scan lines S1 to Sn and data lines D1 to Dm, a scan driver (or scan drive circuit) 100 for driving the scan lines S1 to Sn, a data driver (or data drive circuit) 200 for driving the data lines D1 to Dm, and a timing controller (or timing control unit) 500 for controlling the scan driver 100 and the data driver 200.

The timing control unit 500 produces signals data driver control signals DCS and scan driver control signals SCS in accordance with synchronizing signals supplied from the outside. The data driver control signals DCS produced by the timing controller 500 are supplied to the data drive unit 200, and the scan driver control signals SCS are supplied to the scan driver 100. The timing controller 500 supplies input data supplied from the outside to the data driver 200.

The scan driver 100 receives scan driver control signals SCS from the timing controller 500. The scan driver 100 that has received the scan driver control signals SCS produces scan signals, and sequentially supplies the scan signals to the scan lines S1 to Sn.

The data driver 200 receives data driver control signals DCS from the timing controller 500. The data driver 200 that has received the data driver control signals DCS produces data signals, and supplies the produced data signals to the data lines D1 to Dm such that the data signals are synchronized with the scan signals.

The display unit 300 receives a first power ELVDD and a second power ELVSS from the outside and supplies them to the pixels 400, and each pixel 400 includes a plurality of transistors and a light emitting device.

Accordingly, the pixels 400 that receive the first power ELVDD and the second power ELVSS controls currents flowing from a first power source supplying the first power ELVDD to a second power source supplying the second power ELVSS via the light emitting device in accordance with the data signals supplied to the data lines.

The data driver 200 includes an output driver (or output unit) 210 for outputting data signals for channels corresponding to the data lines D1 to Dm, and the channels of the output driver 210 are provided with a plurality of corresponding amplifiers that amplify and output the data signals supplied to corresponding ones of the data lines D1 to Dm.

There exist random DC offsets in the amplifiers, and there exist variations between the data signals that are actually output by the amplifiers even if data signals corresponding to the same input data are supplied from the data driver. As a result, the variations appear as the brightness differences between vertical lines and cause stripes to appear in a screen (or image). That is, output variations for channels may be caused by variations in offset voltages of the input terminals of the amplifiers.

In particular, of the active matrix type flat panel displays, organic light emitting displays undergo more severe screen deteriorations due to the output variations between channels than liquid crystal displays employing reversal drive schemes.

According to one embodiment of the present invention, chopping controllers for calibrating offsets at input ends of corresponding amplifiers are provided to reduce or overcome a disadvantage caused by variations in offset voltages of the output terminals of the amplifiers.

That is, the chopping controllers function to periodically change the input terminals of the amplifiers and average the offsets, thereby reducing or removing stripes from a screen.

Figure 2:
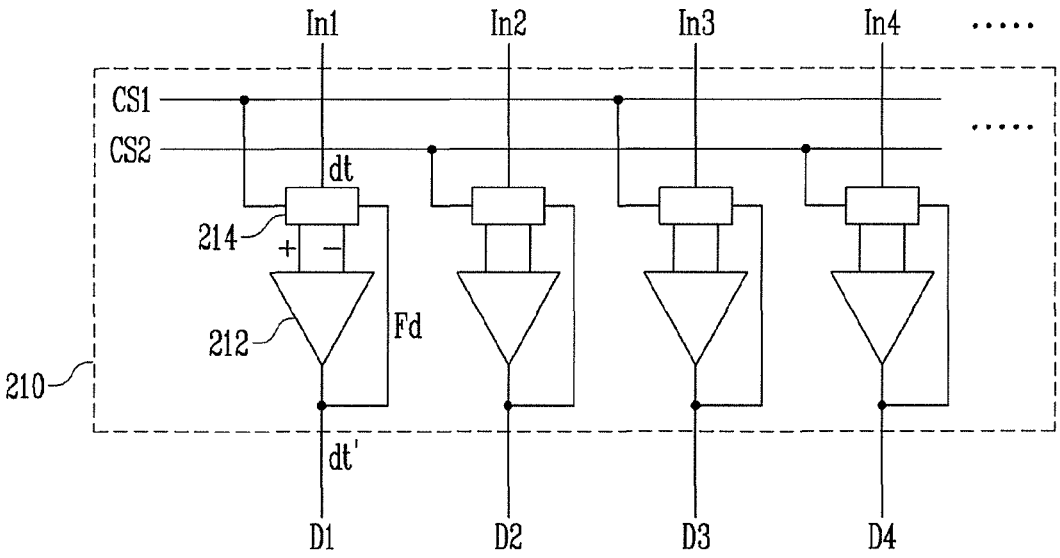
FIG. 2 is a view illustrating the configuration of an output driver of a data driver of FIG. 1.
Figure 3:
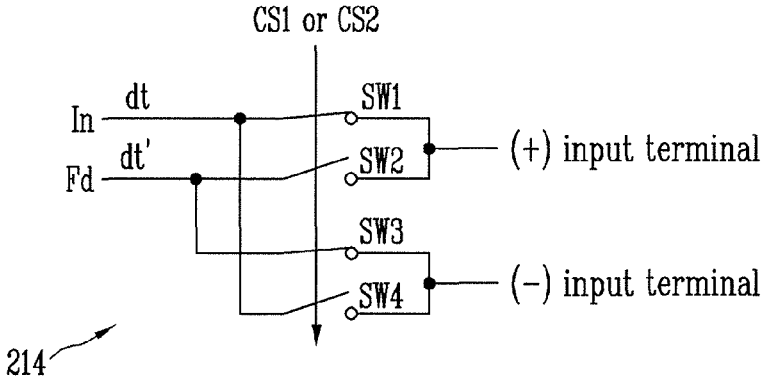
FIG. 3 is a view of an illustrative configuration of a chopping controller provided in the output of FIG. 2 for each channel.

FIG. 2 is a view illustrating the configuration of an output driver of a data driver of FIG. 1. FIG. 3 is a view of an illustrative configuration of a chopping controller provided in the output driver of FIG. 2 for each channel.

Referring to FIG. 2, the output driver 210 of the data driver outputs data signals for channels corresponding to the data lines (e.g., D1, D2, D3, D4, . . . ) and a plurality of amplifiers 212 that amplify and output data signals supplied to the data lines D1 to Dm are provided in corresponding channels of the output driver 210. That is, the number of amplifiers 212 is the same as the number of the channels provided in the data driver.

In one embodiment of the present invention, the chopping controllers 214 are provided at the input ends of the amplifiers 212 and each chopping controller 214 functions to periodically change signals and then supply the signals to a first input terminal (positive input terminal) and a second input terminal (negative input terminal) of the corresponding amplifier 212.

In some flat panel displays, a first data signal dt produced by the data driver and supplied to the output driver 210 is applied to a positive input terminal of an amplifier 212 and is amplified and output by the amplifier 212 as a first prime data signal dt' (e.g., a second data signal). The first prime data signal dt' is fed back and applied to a negative input terminal of the amplifier 212. The first prime data signal dt' is also supplied to a corresponding data line (e.g., D1, D2, D3, D4, . . . ).

That is, in a related art, a signal supplied to an input terminal of an amplifier 212 is fixed. In some embodiments of the present invention, the signal supplied to an input terminal of an amplifier 212 is periodically changed by the chopping controller 214 provided at the input terminal of the amplifier 212.

To achieve this, the chopping controller 214 receives a first or second control signal in addition to a first data signal dt and a first prime data signal dt', and periodically changes the signals applied to the input terminal of the amplifier 212 (e.g., the first data signal dt and the first prime data signal dt') using the control signals.

In one embodiment of the present invention, as illustrated in FIG. 2, a first control signal CS1 is applied to a chopping controller 214 provided in an odd numbered channel of the plurality of channels of the output driver 212 and a second control signal CS2 is applied to a chopping controller provided in an even numbered channel.

The configuration and operation of a chopping controller 214 according to one embodiment of the present invention will be described with reference to FIG. 3.

Referring to FIG. 3, according to one embodiment of the present invention, the chopping controller 214 includes: a first switch SW1 coupled between a positive input terminal of an amplifier and an input line In to which a first data signal dt is applied; a second switch SW2 coupled between the positive input terminal of the amplifier and a feedback line Fd through which a first prime data signal dt' is fed back and applied; a third switch SW3 coupled between a negative input terminal of the amplifier and a feedback line Fd through which a first prime data signal dt' is fed back and applied; and a fourth switch SW4 coupled between the negative input terminal and an input line In to which the first data signal dt is applied.

The first, second, third, and fourth switches SW1, SW2, SW3, and SW4 are turned on or off by the first or second control signals CS1 and CS2, and the first, second, third, and fourth switches SW1, SW2, SW3, and SW4 may be thin film transistors. That is, if the control signal is applied to a gate electrode of the thin film transistor, the thin film transistor is turned on or off by the control signal and the signal supplied to the positive or negative input terminal of the amplifier is selected as the first data signal dt or the first prime data signal dt'.

The first and second switches SW1 and SW3 and the second and fourth switches SW2 and SW4 may have opposite turning on and off operations by the control signals, which, in one embodiment of the present invention, can be achieved by forming thin film transistors of different types.

That is, in one embodiment of the present invention, if the first and third switches SW1 and SW3 are formed by N-type thin film transistors, then the second and fourth switches SW2 and SW4 are formed by P-type thin film transistors, and if the first and third switches SW1 and SW3 are formed by P-type thin film transistors, then the second and fourth switches SW2 and SW4 are formed by N-type thin film transistors.

For example, if the first and third switches SW1 and SW3 are formed by N-type thin film transistors and the second and fourth switches SW2 and SW4 are formed by P-type thin film transistors, when the control signal applied to the switches is at a high level, the first and third switches SW1 and SW3 are turned on and the second and fourth switches SW2 and SW4 are turned off.

Accordingly, a first data signal dt is applied to the positive input terminal of the amplifier by turning on the first switch and a first prime data signal dt' is applied to the negative input terminal of the amplifier by turning on the third switch SW3.

When the control signal applied to the switches is transited to and applied at a low level, the second and fourth switches SW2 and SW4 are turned on and the first and third switches SW1 and SW3 are turned off.

Accordingly, a first prime data signal dt' is applied to the positive input terminal of the amplifier by turning on the second switch SW2 and a first data signal dt is applied to the negative input terminal of the amplifier by turning on the fourth switch SW4.

When the control signals CS1 and CS2 are periodically transited and applied to the chopping controller 214, the signal applied to the input terminal of the amplifier 212 is periodically changed. Accordingly, the offset of the amplifier 212 is averaged to reduce or remove stripes in a screen due to variations of channel outputs.

In order to apply the above-mentioned offset calibration technology to a flat panel display, the changing period of signals provided to a positive or negative input terminal of the amplifier is controlled. In an active matrix type flat panel display (e.g. an organic light emitting display and a liquid crystal display), the period may be determined in units of frames. That is, if the polarity of the offset is changed in units of frames, a user or viewer may be able to perceive the effect of the calibrated offset value, which is an average of two frames.

According to one embodiment of the present invention, a driving method for calibrating the channel output variations may be applied to an active matrix type flat panel display. The offset calibration of offsets by the chopping controller 214 may be realized in four different ways according to the periods of the control signals CS1 and CS2 applied to the chopping controller 214 and the levels of the control signals CS1 and CS2 applied to the odd numbered channels and the even numbered channels.

Hereinafter, four offset calibration methods according to embodiments of the present invention will be described with reference to FIGS. 4 to 7.

Figure 4A:
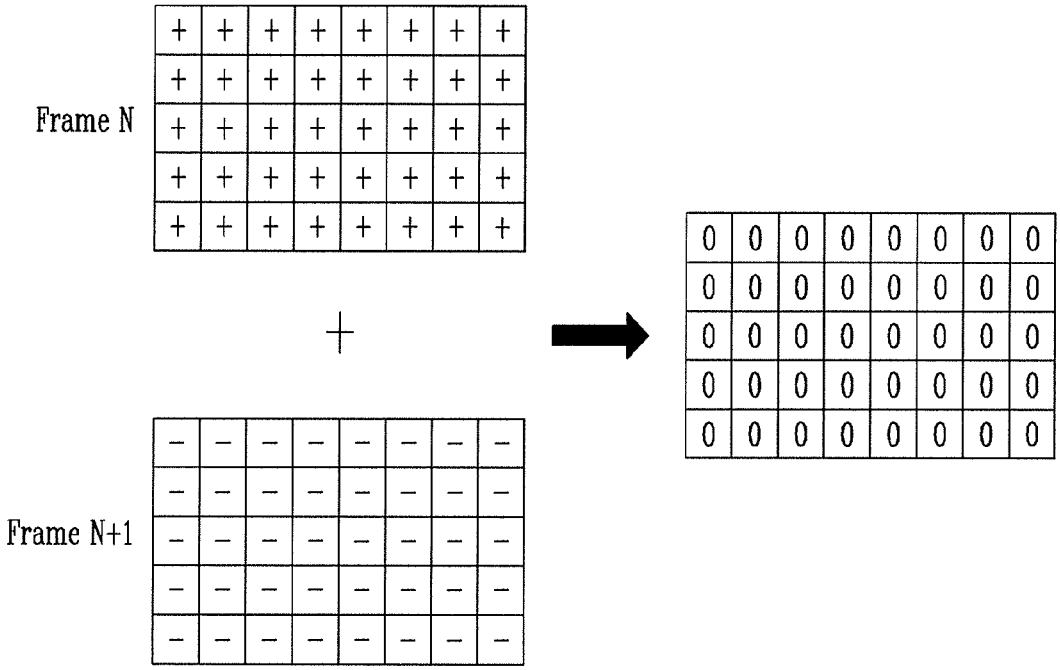
FIG. 4A is a view illustrating an offset calibration method according to a first embodiment of the present invention.
Figure 4B:
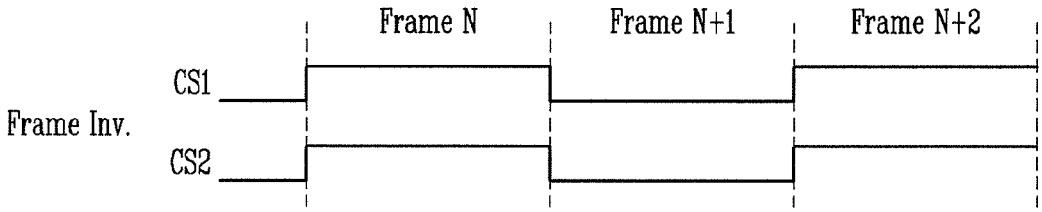
FIG. 4B is a timing diagram of signals for realizing the offset calibration method of the embodiment of FIG. 4A.

FIG. 4A is a view illustrating an offset calibration method according to a first embodiment of the present invention. FIG. 4B is a timing diagram of signals for realizing the offset calibration method of the embodiment of FIG. 4A.

The offset calibration method according to the first embodiment of the present invention is a frame inversion method, and one-directional offsets are output in all frames as illustrated in FIG. 4A and offsets are sequentially changed (e.g., alternated) for respective frames in the method.

That is, a first data signal dt produced by the data driver is supplied to a positive input terminal of an amplifier in the n-th frame Frame N and the first data signal dt is input to a negative input terminal of the amplifier in the (n+1)-th frame Frame N+1.

Through changing the polarities of offsets in units of frames, a viewer may perceive an average of two frames (e.g., a calibrated offset value) to reduce or overcome deterioration of screen quality due to variations of channels.

In the offset calibration method, according to the first embodiment of the present invention as illustrated in FIG. 4B, the first and second control signals CS1 and CS2 are applied at a high level during the n-th frame Frame N, and the first and second control signals CS1 and CS2 are applied at a low level in the (n+1)-th frame Frame N+1. This is sequentially applied in the same way in the following frames.

When the control signal is applied, the chopping controller 214 of one embodiment illustrated in FIG. 3 turns on the first and third switches SW1 and SW3 and turns off the second and fourth switches SW2 and SW4 by applying the control signals CS1 and CS2 at a high level during the n-th frame Frame N so that a first data signal dt is applied to the positive input terminal of the amplifier and a first prime data signal dt' is applied to the negative input terminal of the amplifier.

Thereafter, when the control signals CS1 and CS2 are transited to a low level and applied in the (n+1)-th frame Frame N+1, the second and fourth switches SW2 and SW4 are turned on and the first and third switches SW1 and SW3 are turned off so that a first prime data signal dt' is applied to a positive input terminal of an amplifier and a first data signal dt is applied to a negative input terminal of the amplifier.

Figures 5A, 5B:
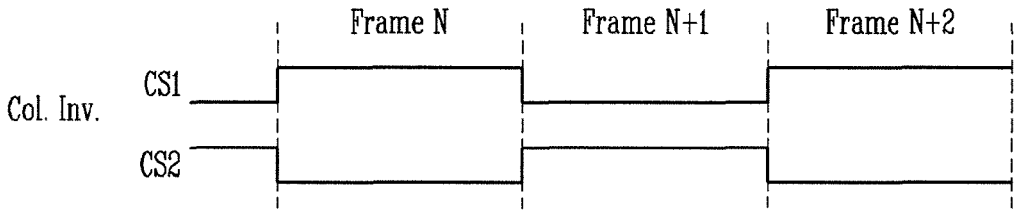
FIG. 5A is a view illustrating an offset calibration method according to a second embodiment of the present invention.
FIG. 5B is a timing diagram of signals for realizing the offset calibration method of the embodiment of FIG. 5A.

FIG. 5A is a view illustrating an offset calibration method according to a second embodiment of the present invention. FIG. 5B is a timing diagram of signals for realizing the offset calibration method of the embodiment of FIG. 5A.

The offset calibration method according to the second embodiment of the present invention is a column inversion method, and, as illustrated in FIG. 5A, the polarities of the offsets are opposite for columns of pixels and the offsets are sequentially changed (e.g., alternated) for frames.

That is, during the n-th frame Frame N, a first data signal dt produced by a data driver is supplied to a positive input terminal of an amplifier for a channel corresponding to an odd numbered column and a first data signal produced by the data driver for a channel corresponding to an even numbered column is supplied to a negative input terminal of the amplifier. They are input in an opposite way during the (n+1)-th frame Frame N+1.

In the offset calibration method, as illustrated in FIG. 5B, a first control signal CS1 is applied at a high level during the n-th frame Frame N and a second control signal CS2 is applied at a low level. Thereafter, during the (n+1)-th frame Frame N+1, the first control signal CS1 is applied at a low level and the second control signal CS2 is applied at a high level in a way opposite to that of the n-th frame Frame N. The first and second control signals CS1 and CS2 are sequentially applied in the following frames in the same way.

When the first and second control signals CS1 and CS2 are applied, the chopping controller 214 of one embodiment illustrated in FIG. 3 turns on the first and third switches SW1 and SW3 and turns off the second and fourth switches SW2 and SW4 by applying the first control signals CS1 at a high level in the odd numbered columns of the n-th frame Frame N so that a first data signal dt is applied to the positive input terminal of the amplifier and a first prime data signal dt' is applied to the negative input terminal of the amplifier.

In the even numbered columns, since the second control signal SC2 is applied at a low level during the n-th frame Frame N, the second and fourth switches SW2 and SW4 are turned on and the first and third switches SW1 and SW3 are turned off, so that a first prime data signal dt' is applied to the positive input terminal of the amplifier and a first data signal dt is applied to the negative input terminal of the amplifier.

Since the levels of the first and second control signals CS1 and CS2 are transited in the (n+1)-th frame Frame N+1, the odd numbered and even numbered offsets are changed (e.g., alternated) and applied.

Figures 6A, 6B:
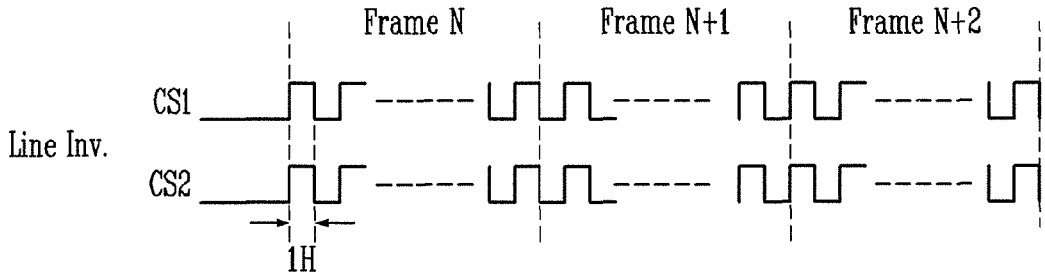
FIG. 6A is a view illustrating an offset calibration method according to a third embodiment of the present invention.
FIG. 6B is a timing diagram of signals for realizing the offset calibration method of the embodiment of FIG. 6A.

FIG. 6A is a view illustrating an offset calibration method according to a third embodiment of the present invention. FIG. 6B is a timing diagram of signals for realizing the offset calibration method of the embodiment of FIG. 6A.

The offset calibration method according to the third embodiment of the present invention is a line inversion method, and, as illustrated in FIG. 6A, deterioration of screen quality due to vertical channel variations is reduced or minimized by changing (e.g., alternating) the polarities of the offsets between adjacent horizontal lines, and offsets are sequentially changed (e.g., alternated) for respective frames.

That is, control signals are transited and applied during a plurality of horizontal time periods 1H of respective frames. In one embodiment of the present invention, the horizontal time periods 1H correspond to time periods during which scan signals are sequentially applied to scan lines.

In this case, during an n-th frame Frame N, first data signal dt produced by the data driver for a plurality of channels corresponding to the odd numbered lines are supplied to a positive input terminal of an amplifier and first data signal dt produced by the data driver for a plurality of channels corresponding to the even numbered lines are input to a negative input terminal of an amplifier, and this is performed in the opposite way during the (n+1)-th frame Frame N+1.

In the offset calibration method of the embodiment illustrated in FIG. 6B, first and second control signals CS1 and CS2 are applied at a high level during odd numbered horizontal time periods and first and second control signals CS1 and CS2 are applied at a low level for the even numbered horizontal time periods in the n-th frame Frame N. Thereafter, the control signals CS1 and CS2 are applied in the opposite way during the (n+1)-th frame Frame N+1. The first and second control signals CS1 and CS2 are applied in the same way (e.g., alternating) in the following frames.

When the control signals are applied, the chopping controller as illustrated in FIG. 3 turns on the first and third switches SW1 and SW3 by applying the first and second signals CS1 and CS2 in the odd numbered lines of the n-th frame Frame N, and applies a first data signal dt to a positive input terminal of an amplifier and applies a first prime data signal dt' to a negative input terminal of the amplifier by turning off the second and fourth switch SW2 and SW4.

When the first and second control signals CS1 and CS2 are applied at a low level to the even numbered lines during the n-th frame Frame N, the second and fourth switches SW2 and SW4 are turned on and the first and third switches SW1 and SW3 are turned off so that the first prime data signal dt' is applied to the positive input terminal of the amplifier and the first data signal dt is applied to the negative input terminal of the amplifier.

Figures 7A, 7B:
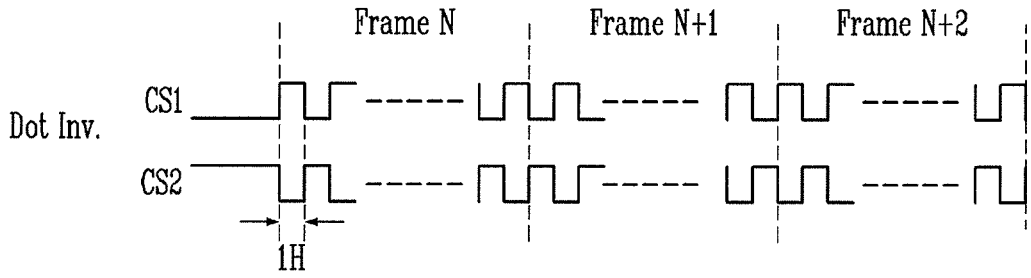
FIG. 7A is a view illustrating an offset calibration method according to a fourth embodiment of the present invention.
FIG. 7B is a timing diagram of signals for realizing the offset calibration method of the embodiment of FIG. 7A.

FIG. 7A is a view illustrating an offset calibration method according to a fourth embodiment of the present invention. FIG. 7B is a timing diagram of signals for realizing the offset calibration method of the embodiment of FIG. 7A.

The offset calibration method according to the fourth embodiment of the present invention is a dot inversion method, and as illustrated in FIG. 7A, the polarities of offsets for all adjacent pixels are disposed in opposite to each other, and offsets are sequentially changed (e.g., alternated) for respective frames.

That is, first and second control signals have opposite levels during each of a plurality of horizontal time periods 1H of respective frames and are transited and applied. In one embodiment, the horizontal time periods correspond to periods during which scan signals are sequentially applied to scan lines.

In the offset calibration method, as illustrated in FIG. 7B, a first control signal CS1 is applied at a high level during an even numbered horizontal time period and a second signal CS2 is applied at a low level during the n-th frame Frame N. The first control signal CS1 is applied at a low level and the second control signal CS2 is applied at a high level during an even numbered horizontal time period. Thereafter, the signals are applied in an opposite way in the (n+1)-th frame Frame N+1. The first and second control signals are sequentially applied in the same way (e.g., alternating) in the following frames.

When the control signals are applied, during the n-th frame Frame N, the chopping controller 214 illustrated in FIG. 3 applies a first data signal dt to a positive input terminal of an amplifier corresponding to an odd numbered column of an odd numbered line and applies a first prime data signal dt' to a negative input terminal of the amplifier.

Similarly, during the n-th frame Frame N, the first data signal dt is applied to a positive input terminal of an amplifier corresponding to an even numbered column of an even numbered line and a first prime data signal dt' is applied to a negative input terminal of the amplifier.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A data driver of a flat panel display comprising:

an output driver configured to output a plurality of amplified data signals for a plurality of channels corresponding to a plurality of data lines, the plurality of channels comprising:

a plurality of amplifiers configured to amplify a plurality of input data signals and to supply the amplified data signals to the data lines; and a plurality of chopping controllers, each of the chopping controllers being coupled to a plurality of input terminals of a corresponding amplifier of the amplifiers and configured to receive a first control signal or a second control signal to periodically change signals applied to positive and negative input terminals from among the input terminals of the amplifiers, wherein each of the chopping controllers comprises:

a first switch coupled between the positive input terminal of the corresponding amplifier and an input line configured to supply a first data signal of the input data signals;

a second switch coupled between the positive input terminal of the corresponding amplifier and a feedback line configured to feed back and apply a second data signal of the amplified data signals;

a third switch coupled between the negative input terminal of the corresponding amplifier and the feedback line; and a fourth switch coupled between the negative input terminal and the input line, and wherein a first plurality of the amplifiers is configured to supply a first plurality of the amplified data signals in a first polarity whenever the first control signal is supplied at a first level and to supply the first plurality of the amplified data signals in a second polarity whenever the first control signal is supplied at a second level, the first polarity being different from the second polarity and the first level being different from the second level.

2. The data driver as claimed in claim 1, wherein the first control signal is applied to the chopping controllers provided in odd numbered channels of the channels and the second control signal is applied to the chopping controllers provided in even numbered channels of the channels.

3. The data driver as claimed in claim 1, wherein the second data signal is a signal obtained by amplifying the first data signal through the amplifier.

4. The data driver as claimed in claim 1, wherein the first, second, third, and fourth switches are configured to be turned off by the first control signal or the second control signal.

5. The data driver as claimed in claim 1, wherein the first, second, third, and fourth switches are thin film transistors.

6. The data driver as claimed in claim 1, wherein the first and third switches are thin film transistors of a first type and the second and fourth switches are thin film transistors of a second type.

7. A method of driving a data driver of a flat panel display, the method comprising:

applying a first data signal to positive input terminals of amplifiers provided of channels corresponding to a plurality of data lines, and applying a second data signal to negative input terminals of the amplifiers;

switching, periodically, the first data signal and the second data signal applied to positive and negative input terminals of amplifiers by applying first and second control signals; and outputting the second data signal to the plurality of data lines, wherein the outputted second data signal comprises a first plurality of data signals, wherein the first plurality of data signals of the outputted second data signal has a first polarity whenever the first control signal has a first level and wherein the first plurality of data signals of the outputted second data signal has a second polarity whenever the first control signal has a second level, the first polarity being different from the second polarity and the first level being different from the second level.

8. The method as claimed in claim 7, wherein the second data signal is a signal obtained by amplifying the first data signal through the amplifiers.

9. The method as claimed in claim 7, wherein the first control signal is applied to the amplifiers provided in odd numbered channels and the second control signal is applied to the amplifiers provided in even numbered channels.

10. The method as claimed in claim 9, wherein the first and second control signals are applied at the first level during an n-th frame, and are applied at the second level during an (n+1)-th frame, the second level having a polarity opposite to a polarity of the first level.

11. The method as claimed in claim 9, wherein the first control signal is applied at the first level having a first polarity during an n-th frame and is applied at the second level having a second polarity opposite to the first polarity during an (n+1)-th frame, and the second control signal is applied at the second level during the n-th frame and is applied at the first level during the (n+1)-th frame.

12. The method as claimed in claim 9, wherein the first and second control signals are applied at the first level having a first polarity during a plurality of odd numbered time periods of an n-th frame and are applied at the second level having a second polarity opposite to the first polarity during a plurality of horizontal time periods of the n-th frame, and the first and second control signals are applied in the opposite way in the (n+1)-th frame.

13. The method as claimed in claim 9, wherein the first signal is applied at the first level having a first polarity during odd numbered horizontal time periods of an n-th frame and the second signal is applied at the second level having a polarity opposite to the first polarity during an n-th frame, and the first and second control signals are applied in the opposite way in an (n+1)-th frame.

* * * * *